US012075896B2

(12) United States Patent
Song Kündig

(10) Patent No.: US 12,075,896 B2
(45) Date of Patent: Sep. 3, 2024

(54) LUGGAGE

(71) Applicant: JENSONG GMBH, Zug (CH)

(72) Inventor: Jennifer Song Kündig, Zug (CH)

(73) Assignee: JENSONG GMBH, Zug (CH)

( * ) Notice: Subject to any disclaimer, the term of this patent is extended or adjusted under 35 U.S.C. 154(b) by 611 days.

(21) Appl. No.: 17/263,991

(22) PCT Filed: Jun. 21, 2019

(86) PCT No.: PCT/IB2019/055252

§ 371 (c)(1),
(2) Date: Jan. 28, 2021

(87) PCT Pub. No.: WO2020/030997

PCT Pub. Date: Feb. 13, 2020

(65) Prior Publication Data

US 2021/0298441 A1 Sep. 30, 2021

(30) Foreign Application Priority Data

Aug. 10, 2018 (GB) ..... 1813019
Nov. 28, 2018 (GB) ..... 1819383

(51) Int. Cl.
*A45C 13/26* (2006.01)
*A45C 5/14* (2006.01)

(52) U.S. Cl.
CPC ..... *A45C 13/262* (2013.01); *A45C 5/14* (2013.01); *A45C 2005/147* (2013.01); *A45C 2013/265* (2013.01)

(58) Field of Classification Search
CPC ... A45C 13/262; A45C 5/14; A45C 2005/147; A45C 2013/265
See application file for complete search history.

(56) References Cited

U.S. PATENT DOCUMENTS

2008/0230339 A1* 9/2008 Pereira ..... A45C 5/14 280/47.2
2015/0181998 A1 7/2015 Yamamoto

FOREIGN PATENT DOCUMENTS

DE 10 2008 028813 A1 12/2009
EP 2 995 215 A1 3/2016
(Continued)

OTHER PUBLICATIONS

Corresponding International Application No. PCT/IB2019/055252—International Search Report mailed on Jan. 31, 2020.
(Continued)

*Primary Examiner* — Don M Anderson
*Assistant Examiner* — Jessica Kavini Tamil
(74) *Attorney, Agent, or Firm* — CURATOLO SIDOTI & TRILLIS CO., LPA; Floyd Trillis, III; Salvatore A. Sidoti

(57) ABSTRACT

A luggage item (1) comprising a rigid, essentially rectangular box (3), comprising an essentially planar floor and two longer and two shorter sides, there being mounted on the major axis of the floor a telescopic pulling member (17) equipped with a pulling handle (18), characterised in that (a) the pulling member is mounted externally on the floor by means of a pivot (8) and can move through a fixed arc, the extremities of which arc are appropriate for sliding a luggage item on a staircase, the pulling member being lockable in a position coinciding with the major axis;

(b) the luggage item comprises a secondary retaining means that prevents the pulling member being pulled out of the plane of the arc; and (c) the longer sides are provided with means (14) allowing sliding movement on a staircase.

The luggage item can easily be pulled up and down stairs.

10 Claims, 3 Drawing Sheets

(56) References Cited

FOREIGN PATENT DOCUMENTS

| | | | | |
|---|---|---|---|---|
| IN | 39/2015 | | 9/2015 | |
| JP | 5547333 | B1 * | 7/2014 | ..... A45C 13/262 |
| JP | 6298754 | B2 | 3/2018 | |

OTHER PUBLICATIONS

Corresponding International Application No. PCT/IB2019/055252—International Written Opinion, mailed on Jan. 31, 2020.
Corresponding Great Britain Application No. 1803852.1—Search Report issued on Jun. 22, 2018.

* cited by examiner

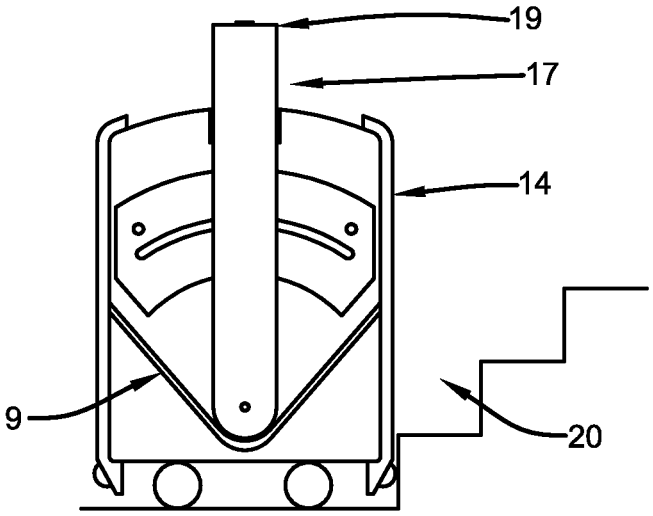
FIG. 3a
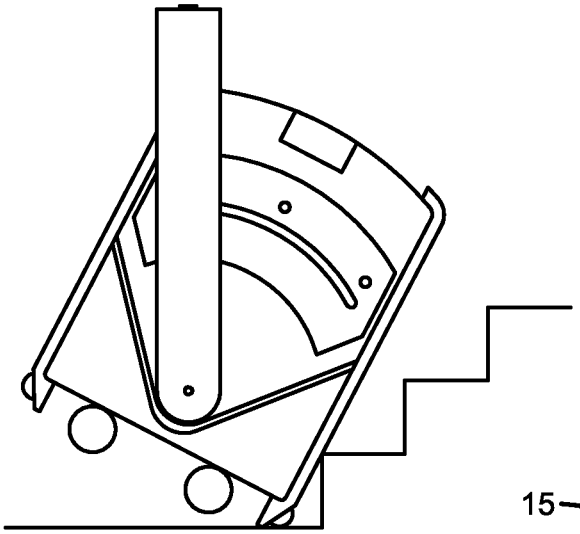
FIG. 3b
FIG. 3c
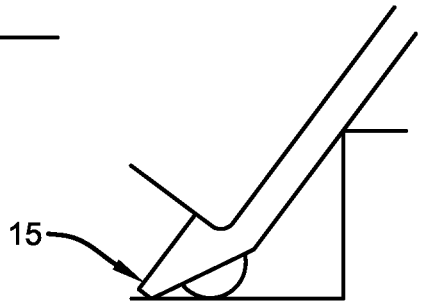
FIG. 3d
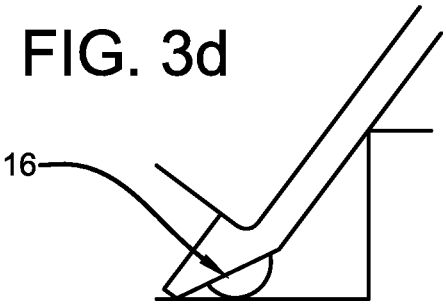
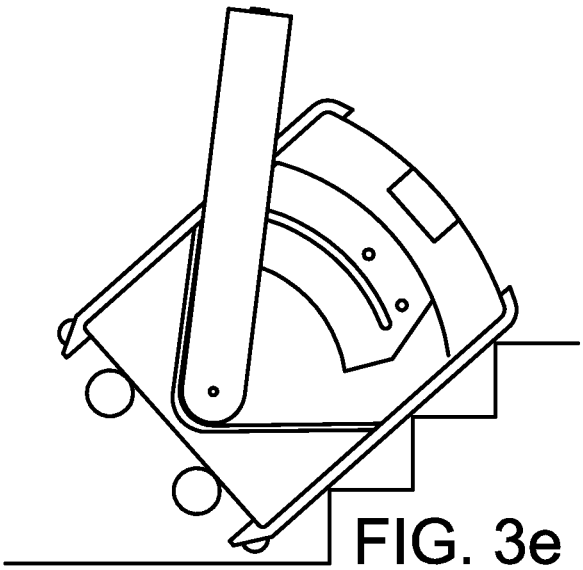
FIG. 3e

LUGGAGE

CROSS REFERENCE TO RELATED APPLICATIONS

This application is a national stage application of International Application No. PCT/IB2019/055252, filed 21 Jun. 2019, which claims priority from Great Britain Patent Application Nos. 1813019.5, filed 10 Aug. 2018 and 1819383.9, filed 28 Nov. 2018 which applications are incorporated herein by reference.

This disclosure relates to luggage, and more particularly to luggage having a rigid floor.

Luggage items such as suitcases with a rigid floor, that is, an essentially flat, rigid surface that forms a major external surface of the luggage, on which it rests for packing and unpacking, are very common. Typically the luggage item will also have at least one of substantially rigid sides and lid; this affords the maximum possible protection for potentially breakable contents against rough handling to which such luggage is inevitably exposed during its service life, particularly when being loaded on to or off aircraft.

It has become common to equip such luggage with small wheels and telescopic handles, to allow them to be moved more easily, and these have become a common sight in airports. The telescopic handles commonly comprise two parallel telescopic members, joined at the top by a cross handlebar. Other comprise a single handle, generally attached to telescoping members of rectangular cross-section, affixed centrally to and retractable into a housing in the rigid floor These allow luggage items to be moved easily along flat surfaces. However, getting heavy luggage items up staircases when they are too heavy to be carried remains a problem.

A number of solutions to this problem have been proposed. A typical example is that described in European patent 2 995 215, in which a luggage item comprises two parallel side rails, mounted on each side of the luggage item, joined by a pull handle and able to pivot from a basic position (the normal position for pulling the luggage along a flat surface) to a special position that allows the luggage item to be more easily pulled up stairs.

A further solution may be found in US publication 2015/181998, in which a pivoting handle may be mounted on a sidewall of a suitcase, pivoting in an arc coplanar with the side of the suitcase. However, if the handle is pulled out of the plane of the arc, damage may result, rendering the mechanism unusable.

It has now been found that it is possible to provide an alternative solution to the problem of getting a relatively heavy luggage item up or down a staircase. There is therefore provided a luggage item comprising a rigid, essentially rectangular box, the box comprising an essentially planar floor and two longer and two shorter sides, there being mounted on the major axis 20 of the floor a telescopic pulling member equipped with a pulling handle, and the shorter side remote from the pulling handle, being provided with wheels, characterised in that (a) the pulling member is mounted externally on the floor by means of a pivot and is capable of being moved through a fixed arc, the extremities of which arc are appropriate for sliding a luggage item on a staircase, the pulling member being lockable in a position coinciding with the major axis;

(b) the luggage item comprises a secondary retaining means that prevents the pulling member being pulled out of the plane of the arc; and (c) the longer sides are provided with means allowing sliding movement on a staircase;

The remainder of the description shall refer to a suitcase, which is a particular embodiment of the disclosure, but the skilled person will be able to perceive other possibilities falling within the scope of the general term "luggage item", to which the disclosure might also apply.

The telescopic pulling member typically has the form of telescoping elements, the innermost of which bears a handle for pulling, the whole being configured such that the pulling member can be completely lockably retracted for transport and pulled out to its full extent for movement. Mechanisms for permitting this are well known to and widely used by the art, and any of the known mechanisms may be used in the pulling member of this disclosure. The nature of the telescoping sections may be any suitable configuration that prevents one turning within the other. For this reason, and for space-saving and costs of manufacture, this generally means that they are essentially of narrow rectangular cross-section, but other configurations are also possible. The pulling member may be made of any suitable material, such as steel, aluminium and reinforced plastics.

The telescopic pulling member is attached to the suitcase floor by means of a pivot mounted on the major axis of the floor, that is, on the axis parallel to the longer sides of the suitcase. This is quite different from standard suitcases, in which the pulling member is rigidly fixed to the suitcase. It is also mounted externally on the floor, in order that it can pivot freely. The telescopic pulling member and pivot may be completely exposed, or they may be fitted with a cover that covers and protects the pulling member in all its possible configurations.

The magnitude of the arc through which the pulling member can be pivoted depends entirely on the nature and size of the luggage and may be readily determined in each case by simple, non-inventive experimentation. In general, the total possible angle of pivot between extremes will not exceed 90°, that is, 45° from the floor major axis in each direction. The arc of pivot need not extend equally to both sides of the floor major axis, and may in a particular embodiment extend to only one side.

The pivot may be the sole attachment of the pulling member to the floor, but this exposes it to potential strain should the pulling member be pulled out of the plane of the arc, especially with a heavy suitcase. In a particular embodiment, this strain may be minimised by provision of a secondary retaining means that prevents the pulling member being pulled out of the plane of the arc. This secondary retaining means may be any suitable means that is placed somewhere along the arc described by the pulling member and capable of preventing excessive movement out of the plane of the arc.

For example, the cover hereinabove mentioned may be made sufficiently strong and rigid to perform this function. Thus, any tendency to pull the pulling member out of the plane of the arc and place undue strain on the pivot is prevented by the pulling member coming into contact with the cover.

In another embodiment, the secondary retaining means may be a bar mounted on the floor and sufficiently spaced therefrom to permit pivoting movement, but which serves to retain the pulling member from being pulled out of the plane of the arc. The pulling member may be provided with sliding contacts on one or both sides to assist ease of movement. These may be made of any suitable material, such as nylon.

In a further embodiment, the secondary retaining means comprises an arcuate slot formed in the floor member, the slot being radial to the pivot, in which slot slides a pin attached to the pulling member and having a head portion wider than the slot on the side of the plate remote from the pulling member, such that the pulling member cannot be pulled away from the floor. This minimises any strain on the pivot when moving a heavy suitcase. The slot may be formed in the floor, or it may be a plate of any suitable material, such as steel, affixed to the floor by any convenient means.

The pulling member is lockable in a position coinciding with the major axis of the floor, to allow easy movement along a horizontal floor. Locking and release may be achieved by any of the mechanisms well known to the art. In a particular embodiment, the pulling member is additionally lockable at the extremes of the arc. Additional lockable positions intermediate between these positions are also possible.

In an unlocked configuration, the pulling member may be pivoted to one of the two extreme positions of the arc. The maximum degree of arc may be fixed by any convenient means. In a particular embodiment, the angle is fixed by the floor construction itself. In this embodiment, the pivot is located at the apex 21 of a V-shaped step in the floor, the step having walls substantially perpendicular to the floor and within which the pulling member resides, the pivoting motion being limited by the pulling member coming into contact with these sides, which act as stops. As mentioned hereinabove, the pulling member may be locked at the arc extremes.

The pulling member is equipped with a pulling handle. In order to facilitate the moving of a suitcase on a staircase, this handle may be pivoted through 90°. Alternatively, the handle may comprise grips mounted perpendicularly to the normal grip, the overall grip having a rectangular shape with grips on three sides. This handle may be recessed into the body of the suitcase in the standard manner for transport.

In order to facilitate movement on a staircase, the longer sides are equipped with means allowing the suitcase to slide on a staircase. These additionally serve the purpose of protecting the suitcase from abrasion and damage. These sliding means can be any suitable means. In one embodiment, they are elongate skids of any suitable material, such as plastics or metal, and may be designed to be readily replaceable. The sliding means can also be more complex, such as caterpillar tracks of rubber or metal. These make movement easier, but have the disadvantage of costing more, being more complex and more prone to breakage.

In a particular embodiment, the sliding means are elongate skids whose lower ends extend in the direction of the wheels to the extent of less than the extent to which the wheels extend. These skid extensions are angled inwardly towards the corresponding skid on the other side, for example, by being formed with an inwards bend, or by having a narrowing bevelled surface. Such an extension assists in the transition from normal rolling movement to sliding movement on a staircase, in that the extensions make contact with the floor and prevent slipping in the transition from wheels to skids or vice versa. In a further embodiment, the angled surfaces bear wheels. This helps further the transition from sliding on a staircase to moving along a horizontal floor, and vice versa.

The disclosure is further described with reference to the accompanying drawings, which depict a particular embodiment and which is not meant to be in any way limiting FIG. 1 is a perspective view of a suitcase with a pulling member dismounted, better to see the structure.

FIG. 3 is a diagrammatic representation (not to scale) of a suitcase of FIGS. 1 and 2 being moved up a staircase.

Figure 1:
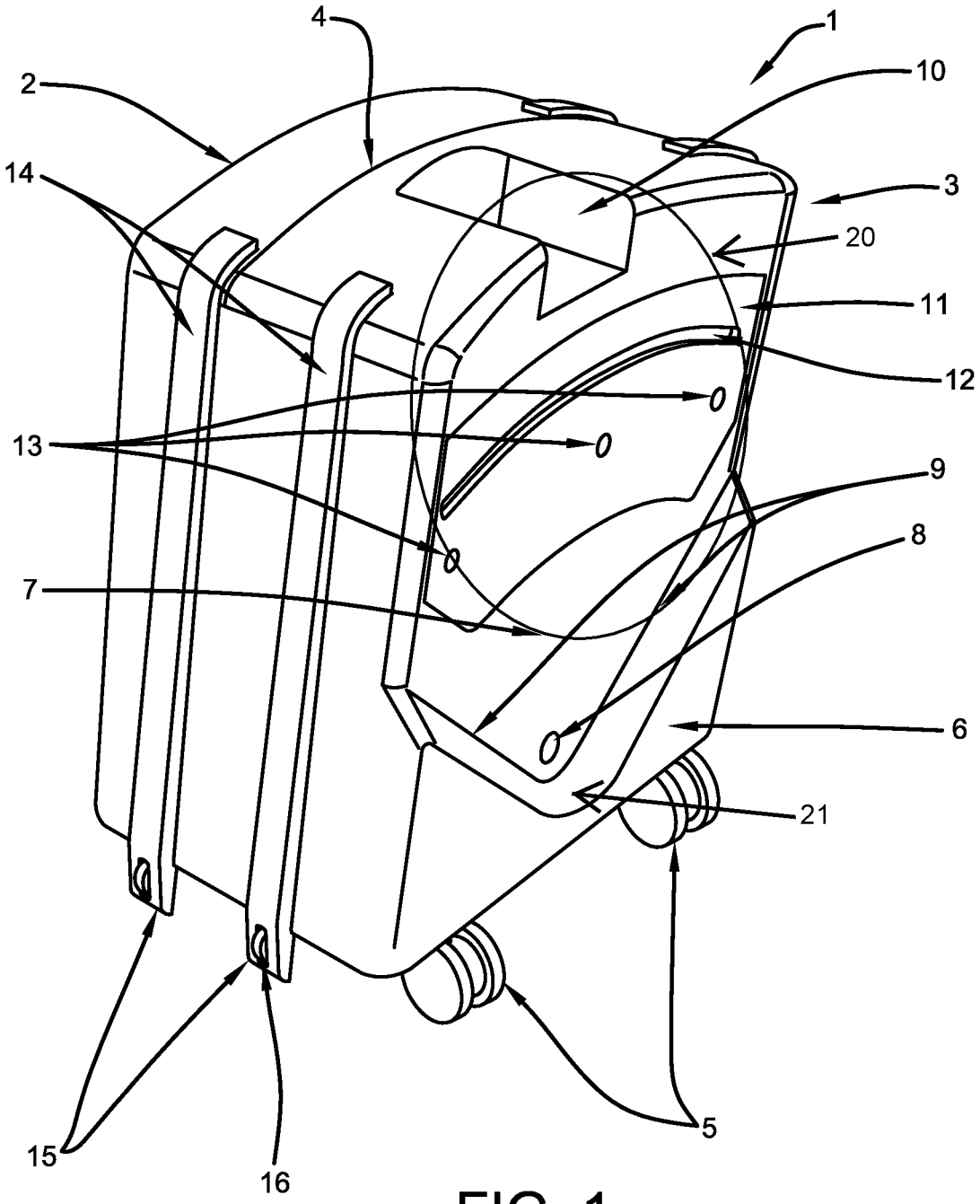

In FIG. 1, a suitcase, generally indicated as 1 is formed from plastics materials in two moulded box portions, a lid portion 2 and a side/floor portion 3, closed by a zip fastener 4.

The suitcase can be moved easily by means of four castors, 5, mounted at one end of the suitcase, two on each of the portions 2 and 3.

The exterior of portion 3 has a stepped structure, the stepped portion 6 defining a V-shaped recess 7, the lower rounded end of the V providing a pivot point 8 for the pulling member, which fits within the V, whose sides 9 form boundaries for the pulling member, beyond which it cannot pivot. The portion 3 is additionally provided with a recess 10, adapted to receive a pulling handle (17 in FIG. 2) when the pulling member is fully retracted.

Into a further recess within the Vis affixed a metal plate 11, the surface of the plate being flush with the surface of the V. The plate bears a slot 12, which is radial with respect to the pivot point 8 and is adapted to receive a sliding member affixed to the pulling member, the sliding member having on the opposite side of the plate 11 an enlarged portion, such that the pulling member cannot be pulled away from the suitcase, the recess into which the plate is fitted being sufficiently deep to accommodate the enlarged portion. The plate additionally comprises three locking holes 13, into which a locking pin on the pulling member can fit, to hold the moving member in one of three possible positions.

Mounted on each of the longer sides of the suitcase are two skids 14 of resilient material such as fibre-reinforced plastics. These skids extend beyond the sides in extensions 15, in the direction of, but not to the same extent as, the castors 5. The extensions are bevelled such that they narrow in the direction of the wheels. The bevelled surfaces may bear slots, in which are mounted wheels 16, which assist in the transition from flat surfaces to staircases, as will be further described hereinunder.

Figure 2:
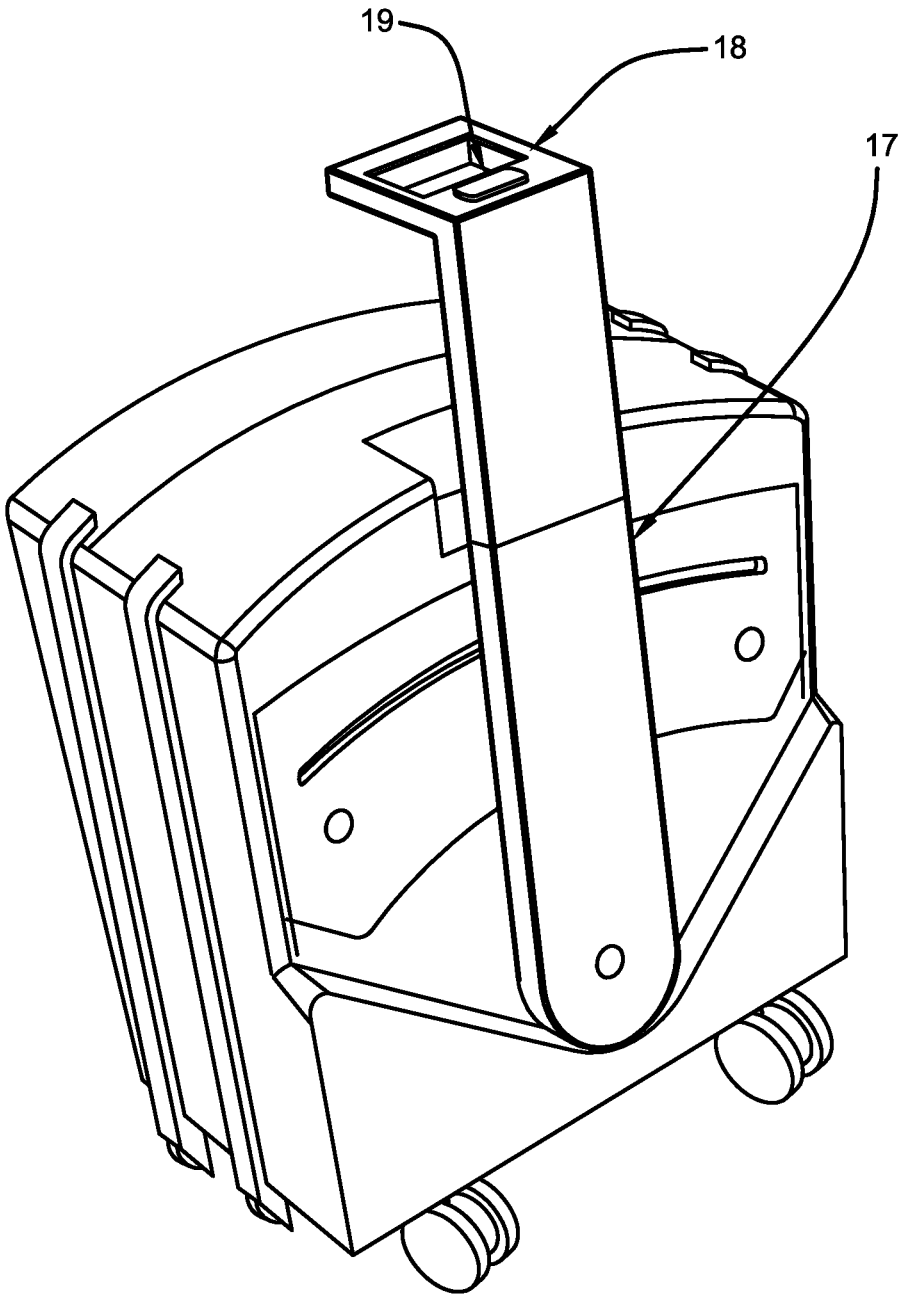
FIG. 2 is a perspective view of the embodiment of FIG. 1 same view as FIG. 1, showing the pulling member and pulling handle in place, with the pulling member fully extended and the pulling member locked in a central position.

FIG. 2 shows the embodiment of FIG. 1 equipped with a pulling member 16 shown in the fully extended position. At the top is a pulling handle 18, this having the shape of a hollow rectangle with grips on three sides, such that the suitcase can be moved on the flat or on a staircase. The pulling member is locked in position by means of a locking pin (not shown) interacting with the central locking hole 13. Both the locking pin and the retraction of the handle into the recess 10 are actuated by a button 19 on the pulling handle 18.

In FIG. 3, a suitcase is shown being pulled up a staircase.

In FIG. 3*a*, the pulling member 17 is fully extended and locked in the central pulling position, the suitcase moving on the castors 5. The skids 14 are pushed against the first step of the staircase 20.

In FIG. 3*b*, the locking button 19 is depressed. This unlocks the pulling member 17 from its central position, and it is then pivoted, in the case shown, in an anticlockwise direction until it abuts the side 9 of the V-shaped recess 7. It may then be locked in this position by means of the locking hole 13 for this position. The suitcase is then tilted with the skids 14 against the first stair. As tilt continues, the skid extensions 15 touch the ground, preventing slipping, and the suitcase pivots around them. This is shown in magnified detail in FIG. 3*c*.

With further tilting, the wheels 16 mounted on the extensions come in contact with the floor, allowing the suitcase to be moved more easily to bring the skids 14 into contact with the steps of the staircase 20. This is shown in magnified detail in FIG. 3*d*.

In FIG. 3*e*, the transition from castors to skids 14 is now complete and the suitcase is now complete, and the suitcase 2 may be pulled up or down the staircase with relative ease.

This procedure works also for going down a staircase—the pulling member 18 is moved to the appropriate extreme pivot position and the suitcase pivoted, first on the extensions 14 and then on to the wheels 15, which allow the suitcase to be rolled on to the skids 14 on the steps.

The skilled person will appreciate that there are possible many workshop variations on this embodiment, all within the skill of the art, and all falling within the scope of this disclosure.

The invention claimed is:

1. A luggage item (1) comprising a rigid, essentially rectangular box (3), the box comprising an essentially planar floor and two longer and two shorter sides, there being mounted on a major axis (20) of the floor a telescopic pulling member (17) equipped with a pulling handle (18), and the shorter side remote from the pulling handle, being provided with wheels (5), characterised in that (a) the pulling member is mounted externally on the floor by means of a pivot (8) and is configured to be moved through a fixed arc, the extremities of which arc are appropriate for sliding a luggage item on a staircase, the pulling member being lockable in a position coinciding with the major axis;

(b) the luggage item comprises a secondary retaining means (11, 12) that prevents the pulling member being pulled out of the plane of the arc, in which the secondary retaining means comprises an arcuate slot (12) formed in the floor member, the slot being radial to the pivot, in which slot slides a pin attached to the pulling member and having a head portion wider than the slot on a side of a plate remote from the pulling member, so that the pulling member cannot be pulled away from the plane of the arc; and (c) the longer sides are provided with means (14) allowing sliding movement on a staircase.

2. The luggage item according to claim 1, in which the arc through which the pulling member may be moved extends to both sides of the major axis.

3. The luggage item according to claim 2, in which the arc extends equally to both sides of the major axis.

4. The luggage item according to claim 1, in which the arc extends to only one side of the major axis.

5. The luggage item according to claim 1, in which the secondary retaining means comprises a rigid cover covering most or all of the pivoting pulling member.

6. The luggage item according to claim 1, in which the secondary retaining means comprises a bar mounted on the floor and sufficiently spaced therefrom to permit pivoting movement, but which serves to retain the pulling member from being pulled out of the plane of pivoting.

7. The luggage item according to claim 1, in which a sliding means comprise skids (14).

8. The luggage item according to claim 7, in which the skids comprise lower extensions (15) extending less than the distance to which the wheels extend, the skid extensions being angled inwardly in the direction of the opposing skid.

9. The luggage item according to claim 8, in which an angled part of the extensions bear slots into which are fitted wheels (16).

10. A luggage item (1) comprising a rigid, essentially rectangular box (3), the box comprising an essentially planar floor and two longer and two shorter sides, there being mounted on a major axis (20) of the floor a telescopic pulling member (17) equipped with a pulling handle (18), and the shorter side remote from the pulling handle, being provided with wheels (5), characterised in that (a) the pulling member is mounted externally on the floor by means of a pivot (8) and is configured to be moved through a fixed arc, the extremities of which arc are appropriate for sliding a luggage item on a staircase, the pulling member being lockable in a position coinciding with the major axis;

(b) the luggage item comprises a secondary retaining means (11, 12) that prevents the pulling member being pulled out of the plane of the arc, in which a maximum degree of arc is fixed by walls (9) of a V-shaped step in the floor (6), the pivot being located at an apex (21) of the step, the step having walls substantially perpendicular to the floor and within which the pulling member resides, a pivoting motion being limited by the pulling member coming into contact with these sides; and (c) the longer sides are provided with means (14) allowing sliding movement on a staircase.

* * * * *